US010928118B2

(12) United States Patent
Xingbiao et al.

(10) Patent No.: US 10,928,118 B2
(45) Date of Patent: Feb. 23, 2021

(54) DOOR OF REFRIGERATION DEVICE, AND REFRIGERATION DEVICE

(71) Applicants: Dometic Sweden AB, Solna (SE); Dometic (Zhuhai) Technology Co., Ltd., Guangdong (CN)

(72) Inventors: Yang Xingbiao, Zhuhai (CN); Guan Weixian, Zhuhai (CN); Peng Wang, Zhuhai (CN); Weng Xiaoli, Zhuhai (CN)

(73) Assignees: Dometic Sweden AB, Solna (SE); Dometic (Zhuhai) Technology Co., Ltd., Zhuhai (CN)

( * ) Notice: Subject to any disclaimer, the term of this patent is extended or adjusted under 35 U.S.C. 154(b) by 0 days.

(21) Appl. No.: 16/839,782

(22) Filed: Apr. 3, 2020

(65) Prior Publication Data

US 2020/0232698 A1 Jul. 23, 2020

Related U.S. Application Data

(63) Continuation of application No. 15/998,459, filed on Aug. 15, 2018, now Pat. No. 10,634,417.

(30) Foreign Application Priority Data

Aug. 16, 2017 (CN) ..... 201710701905.5

(51) Int. Cl.
*E05D 15/50* (2006.01)
*E05D 15/48* (2006.01)
(Continued)

(52) U.S. Cl.
CPC ..... *F25D 23/02* (2013.01); *E05D 15/505* (2013.01); *F25D 23/028* (2013.01); *F25D 11/00* (2013.01); *F25D 2323/024* (2013.01)

(58) Field of Classification Search
CPC ..... F25D 23/02; F25D 23/028; E05D 15/505; E05D 15/502; E05D 15/50
See application file for complete search history.

(56) References Cited

U.S. PATENT DOCUMENTS 1,550,205 A * 8/1925 Cemazar ..... E05D 15/502 16/230
1,749,336 A 3/1930 Geyer
(Continued)

FOREIGN PATENT DOCUMENTS

AU 2018217298 A1 3/2019
CN 2558937 Y 7/2003
(Continued)

OTHER PUBLICATIONS

"Reversing Frigidaire Top Freezer Refrigerator Door," retrieved from Internet URL: http://www.applianceaid.com/reversing-frigidaire-top-freeezer-refrigerator-door.php, on Jan. 15, 2019, pp. 8.
(Continued)

*Primary Examiner* — Kimberley S Wright
(74) *Attorney, Agent, or Firm* — Middleton Reutlinger

(57) ABSTRACT

A door of a refrigeration device, and a refrigeration device. The door comprises a door main body, a retractable shaft, a handle and a first return member. The door main body is used for closing an opening of a refrigeration space. The retractable shaft is slidably disposed on the door main body, with an outer end of the retractable shaft being able to slide with the retractable shaft and extend outwards or retract inwards, and with a first guide face being provided on the retractable shaft. The handle is capable of rotating on the door main body, the handle being provided with a drive part cooperating with the first guide face, wherein when the drive part rotates with the handle, the drive part can slide along the first guide face and drive the retractable shaft to slide inwards. In the door, by making use of the cooperation
(Continued)

between the drive part of the handle and the first guide face, the retractable shaft is driven to slide by the rotation of the handle directly, with no need for another connecting rod structure.

12 Claims, 7 Drawing Sheets

(51) Int. Cl.
*F25D 23/02* (2006.01)
*F25D 11/00* (2006.01)

(56) References Cited

U.S. PATENT DOCUMENTS

| | | | | |
|---|---|---|---|---|
| 2,541,453 | A * | 2/1951 | West | F25D 23/025 62/161 |
| 3,048,898 | A | 8/1962 | Davis | |
| 3,389,424 | A | 6/1968 | Fellwock | |
| 3,455,061 | A | 7/1969 | Kesling et al. | |
| 3,629,972 | A | 12/1971 | Rehberg et al. | |
| 3,675,271 | A | 7/1972 | Fellwock et al. | |
| 3,869,753 | A | 3/1975 | Boback | |
| 4,215,449 | A | 8/1980 | Loikitz | |
| 4,248,489 | A | 2/1981 | Barroero et al. | |
| 4,503,582 | A | 3/1985 | Gurubatham | |
| 4,539,819 | A | 9/1985 | Alba et al. | |
| 4,893,850 | A | 1/1990 | Mizusawa | |
| 5,228,240 | A | 7/1993 | Barroero et al. | |
| D342,743 | S | 12/1993 | Renner | |
| 5,675,934 | A | 10/1997 | Park | |
| 5,802,155 | A | 9/1998 | Garland et al. | |
| 5,829,197 | A | 11/1998 | Oh | |
| 5,926,916 | A * | 7/1999 | Lee | E05D 15/502 16/230 |
| 5,983,453 | A * | 11/1999 | Miwa | E05D 15/505 16/231 |
| 6,609,750 | B1 | 8/2003 | Cauduro | |
| 6,761,278 | B2 | 7/2004 | Hyp | |
| 6,868,692 | B2 | 3/2005 | Choi | |
| 6,883,841 | B2 | 4/2005 | Kawabata | |
| D508,502 | S | 8/2005 | Moseley | |
| 7,043,886 | B1 | 5/2006 | Chubb | |
| 7,784,219 | B2 | 8/2010 | Yoshikawa | |
| 7,810,862 | B2 | 10/2010 | Smith | |
| 7,913,355 | B2 | 3/2011 | Choi | |
| 8,277,005 | B2 | 10/2012 | Jung et al. | |
| 8,966,821 | B2 * | 3/2015 | Walker | E05D 7/1061 49/382 |
| 10,634,417 | B2 | 4/2020 | Xingbiao et al. | |
| 2004/0040212 | A1 | 3/2004 | Kawabata | |
| 2008/0048539 | A1 | 2/2008 | Beek et al. | |
| 2013/0270286 | A1 * | 10/2013 | Fukui | B65D 51/00 220/811 |
| 2014/0075844 | A1 * | 3/2014 | Walker | E05B 1/0092 49/208 |
| 2019/0063132 | A1 | 2/2019 | Ike | |

FOREIGN PATENT DOCUMENTS

| | | | |
|---|---|---|---|
| CN | 202915623 | U | 5/2013 |
| CN | 203240855 | U | 10/2013 |
| CN | 104033058 | A | 9/2014 |
| CN | 203957956 | U | 11/2014 |
| CN | 203964501 | U | 11/2014 |
| CN | 203964502 | U | 11/2014 |
| CN | 203964503 | U | 11/2014 |
| CN | 203964506 | U | 11/2014 |
| CN | 203964508 | U | 11/2014 |
| CN | 203964522 | U | 11/2014 |
| CN | 203964529 | U | 11/2014 |
| CN | 204128268 | U | 1/2015 |
| CN | 102829595 | B | 3/2015 |
| CN | 106168430 | A | 11/2016 |
| CN | 107525337 | A | 12/2017 |
| DE | 202004016063 | U1 | 3/2006 |
| DE | 102018213817 | A1 | 2/2019 |
| EP | 2054684 | A2 | 5/2009 |
| EP | 2896917 | A1 | 7/2015 |
| EP | 3287722 | A1 | 2/2018 |
| WO | 2018037038 | A1 | 3/2018 |

OTHER PUBLICATIONS

"Reversing the Instructions Door Swing" retrieved from Internet URL: http://www.homedepot.com/catalog/pdfImages/0b/0b70c905-3df3-4445-ba23-52ee1417a589.pdf, on Jan. 15, 2019, pp. 4.
Dometic 2015 Product Catalog—Refrigerators.
Dometic 2016 Product Catalog—Refrigerators.
U.S. Appl. No. 16/198,009 "Molded Frame for a Reversible Appliance Door" filed Nov. 21, 2018.
Notification to Grant Patent Right for Invention Mailed in CN Patent Application No. 201710701905.5 dated Dec. 5, 2019.
Design review, "Mobile living made easy," Dometic, CF 45, pp. 11 (Mar. 23, 2017).
First Office Action mailed in CN Patent application No. 201710701905.5 dated Jul. 3, 2019.

* cited by examiner

DOOR OF REFRIGERATION DEVICE, AND REFRIGERATION DEVICE

CLAIM TO PRIORITY

This continuation patent application claims priority to and benefit of, under 35 U.S.C. § 120, U.S. Non-Provisional patent application Ser. No. 15/998,459, filed Aug. 15, 2018, titled "Door of Refrigeration Device, and Refrigeration Device", which claims priority, under 35 U.S.C. § 119(a), to Chinese Patent Application Number 201710701905.5, filed Aug. 16, 2017, all of which is incorporated by reference herein.

BACKGROUND

1. Field of the Invention

The present embodiments relate to refrigeration devices, in particular to a door of a refrigeration device, and a refrigeration device.

2. Description of the Related Art

Some refrigeration devices, such as vehicle-mounted refrigerators, comprise a main body part and a door. A refrigeration assembly and a liner are provided on the main body part; the refrigeration assembly is used to absorb heat of the liner, and the liner generally has an opening, forming a refrigeration space. The door is generally provided with retractable shafts capable of extending and retracting; the main body part is generally provided with opposite supporting parts at the opening, with insertion holes being provided on opposite faces of the supporting parts. The door is placed between the supporting parts, and insert-connected through the cooperation of the retractable shafts with the insertion holes. When the retractable shafts are extended and inserted into the insertion holes, the door is hinge-connected to the supporting parts. When the retractable shafts retract and disengage from the insertion holes, the door is disengaged from the supporting parts.

The structure described above makes it convenient for the door to be disengaged from and hinge-connected to the supporting parts. However, in the prior art, to achieve extension and retraction of the retractable shaft, a push-button which can be pushed is generally provided on the door, with an inner end of the push-button being connected to the retractable shaft by means of a connecting rod. Since the direction in which the push-button is pushed is perpendicular to the direction of extension and retraction of the retractable shaft, the pushing of the push-rod and the extension and retraction of the retractable shaft must be connected by means of the connecting rod, so the structure is complex and reliability is reduced; moreover, the space occupied at the position of the connecting rod is relatively large, which is not favourable for structural arrangement.

SUMMARY

A first object of the present examples is to propose a door of a refrigeration device, capable of realizing extension and retraction of a retractable shaft, wherein the retraction shaft and a handle are simple in structure, occupy little space, and are convenient to arrange.

To achieve this object, the present examples employ the following technical solution:

A door of a refrigeration device, comprising:

a door main body, for closing an opening of a refrigeration space;

a retractable shaft, slidably disposed on the door main body, with an outer end of the retractable shaft being able to slide with the retractable shaft and extend outwards or retract inwards, and with a first guide face being provided on the retractable shaft;

a handle, capable of rotating on the door main body, the handle being provided with a drive part cooperating with the first guide face, wherein when the drive part rotates with the handle, the drive part can slide along the first guide face and drive the retractable shaft to slide inwards;

a first return member, connected separately to the door main body and the retractable shaft, and driving the retractable shaft to slide outwards.

Furthermore, a first guide slot is provided on the retractable shaft, with the first guide face being formed on a side wall of the first guide slot, and the first guide face being arranged to be inclined from a top part of the first guide slot to a bottom part, in a direction of outward extension of the retractable shaft.

Furthermore, the retractable shaft comprises an outer connection part, a bend part and an inner connection part which are connected in sequence; the outer connection part and the inner connection part are parallel and not coaxial; the first return member is a spring, which is connected separately to the bend part and the door main body; the door main body is provided with a first limiting part, for restricting a limit position of outward sliding of the bend part.

Furthermore, multiple second limiting parts are provided on the door main body; the multiple second limiting parts are arranged in sequence in a sliding direction of the retractable shaft, and are provided with limiting grooves in a sliding region of the outer connection part, with the outer connection part sliding in the limiting grooves.

Furthermore, a third limiting part is provided on the door main body; the third limiting part and the bend part are arranged opposite each other, and are each provided with a limiting post in a protruding manner on opposite faces, with two ends of the spring being separately engaged in the limiting posts.

Furthermore, the handle comprises a gripping part, and handle shafts arranged on two sides of the gripping part in a protruding manner; the drive part is connected to an outer end of the handle shaft, and a fourth limiting part is provided on the door main body in a protruding manner, with the fourth limiting part being provided with a rotation groove for accommodating the handle shaft.

Furthermore, the door main body comprises a closing plate and an outer face plate which are fastened together; once the closing plate and the outer face plate have been fastened together, an accommodating region is formed at a side part; the accommodating region accommodates the retractable shaft, the handle and the first return member; the first limiting part, second limiting parts, third limiting part and/or fourth limiting part is/are disposed on the closing plate and/or the outer face plate.

A second object of the present invention is to propose a refrigeration device, a door thereof being capable of realizing extension and retraction of a retraction shaft, wherein the retraction shaft and a handle are simple in structure, occupy little space, and are convenient to arrange.

To achieve this object, the present examples employ the following technical solution:

A refrigeration device, comprising:

a main body part, with a refrigeration space being provided inside the main body part, the refrigeration space being provided with an opening facing outwards, supporting parts being formed in a protruding manner on the main body part at two sides of the opening, inner sides of the supporting parts being opposite one another, and the inner sides of the supporting parts each being provided with a corresponding insertion hole, with each pair of corresponding insertion holes being one set of insertion holes; and the door described above, the door being located between the opposite supporting parts, the door main body being provided with the retractable shaft at a position opposite each of the insertion holes, and the two retractable shafts which correspond to each set of the insertion holes both cooperating with one said handle;

when the outer ends of the retractable shafts extend outwards and are inserted into the insertion holes, the door main body is hinge-connected to the supporting parts; when the handle rotates such that the retractable shafts retract inwards and disengage from the insertion holes, the door main body is separated from the supporting parts.

Furthermore, the supporting parts are provided with two sets of insertion holes; the two sets of insertion holes are located on two sides of the supporting parts respectively, and located on an outer side of the opening.

Furthermore, a hinge connection part is provided in a protruding manner on the inner side of the supporting part; the hinge connection part is provided with the insertion hole, and a second guide slot is provided on an outer side of the insertion hole; a bottom face of the second guide slot is inclined from a top end of the insertion hole to a bottom end, in a direction of extension of the retractable shaft;

a fifth limiting part is provided in a protruding manner on the inner side of the supporting part, and the door main body is provided with a sixth limiting part in a protruding manner on an end face from which the retractable shaft extends; the fifth limiting part and the sixth limiting part cooperate to limit an angle of rotation of the door main body.

Beneficial effects: the present invention provides a door of a refrigeration device, and a refrigeration device. The door comprises a door main body, a retractable shaft, a handle and a first return member. The door main body is used for closing an opening of a refrigeration space. The retractable shaft is slidably disposed on the door main body, with an outer end of the retractable shaft being able to slide with the retractable shaft and extend outwards or retract inwards, and with a first guide face being provided on the retractable shaft. The handle is capable of rotating on the door main body, the handle being provided with a drive part cooperating with the first guide face, wherein when the drive part rotates with the handle, the drive part can slide along the first guide face and drive the retractable shaft to slide inwards. The first return member is connected separately to the door main body and the retractable shaft, and drives the retractable shaft to slide outwards. In the door of the present invention, the first guide face is disposed on the retractable shaft directly, and by making use of the cooperation between the drive part of the handle and the first guide face, the retractable shaft can be driven to slide by the rotation of the handle directly, with no need for another structure such as a connecting rod; the overall structure is simple, the failure rate is low, reliability is high, little space is occupied, and arrangement is convenient. When the handle is released, the first return member maintains an extended state of the retractable shaft, facilitating cooperation with another component, to lock the door.

BRIEF DESCRIPTION OF THE DRAWINGS

In order that the embodiments may be better understood, embodiments of a door of refrigeration device and refrigeration device will now be described by way of examples. These embodiments are not to limit the scope of the claims as other embodiments of an orthopedic brace will become apparent to one having ordinary skill in the art upon reading the instant description. Non-limiting examples of the present embodiments are shown in figures wherein:

In the drawings.

Figure 1:
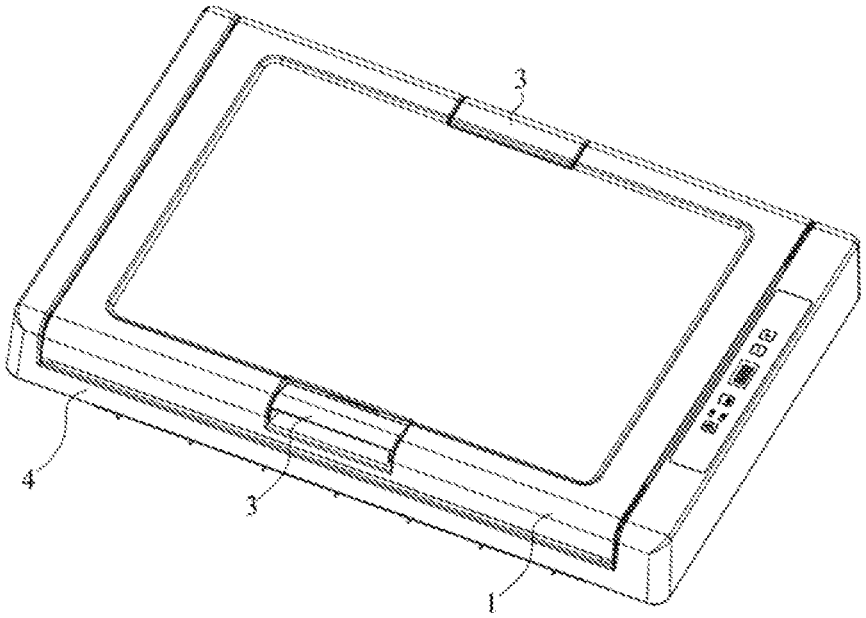
FIG. 1 is a schematic structural diagram of a refrigeration device provided in the present invention when the door is closed.

1—door main body, 11—first limiting part, 12—second limiting part, 121—limiting groove, 13—third limiting part, 131—limiting post, 14—fourth limiting part, 141—rotation groove, 15—closing plate, 16—outer face plate, 17—accommodating region, 18—sixth limiting part, 2—retractable shaft, 21—first guide slot, 211—first guide face, 22—outer connection part, 221—insert-connection part, 23—bend part, 24—inner connection part, 3—handle, 31—gripping part, 32—handle shaft, 33—drive part, 331—abutment face, 34—second return member, 4—first return member, 5—main body part, 51—opening, 52—supporting part, 521—hinge connection part, 522—second guide slot, 523—fifth limiting part, 53—insertion hole.

DETAILED DESCRIPTION

To clarify the technical problem solved by the present examples, the technical solution employed and the technical effects achieved, the technical solution of the present invention is explained further below by means of particular embodiments with reference to the accompanying drawings.

Embodiment 1

As shown in FIGS. 1-13, this embodiment provides a refrigeration device and a door for the refrigeration device. The refrigeration device may be a refrigerator, etc. The refrigeration device comprises a main body part 5 and a door. A refrigeration space is provided inside the main body part 5; the refrigeration space may be formed by an internal cavity of a liner, and the refrigeration space is provided with an opening 51 facing outwards. An article to be refrigerated is placed into the refrigeration space through the opening 51. The door is used to close the opening 51 of the refrigeration space, to keep the refrigeration space isolated from an external environment, so as to achieve a better refrigeration effect.

Specifically, the door comprises a door main body 1, a retractable shaft 2, a handle 3 and a first return member 4. The door main body 1 is a main component of the door, and is used to close the opening 51 of the refrigeration space and form a main body of the entire door. The retractable shaft 2 is slidably disposed on the door main body 1, and is generally located inside the door main body 1. An outer end of the retractable shaft 2 can slide with the retractable shaft 2 and extend outwards or retract inwards; when the outer end of the retractable shaft 2 extends, the door can be mated and hinge-connected to the main body part 5 of the refrigeration device. When the outer end of the retractable shaft 2 retracts, it can disengage from the main body part 5. A first guide face 211 is provided on the retractable shaft 2; extension and retraction are achieved using the first guide face 211. The handle 3 is rotatably disposed on the door main body 1, and is provided with a drive part 33 cooperating with the first guide face 211; when the drive part 33 rotates with the handle 3, the drive part 33 can slide along the first guide face 211 and drive the retractable shaft 2 to slide inwards. The first return member 4 is separately connected to the door main body 1 and the retractable shaft 2, and drives the retractable shaft 2 to slide outwards.

Figure 3:
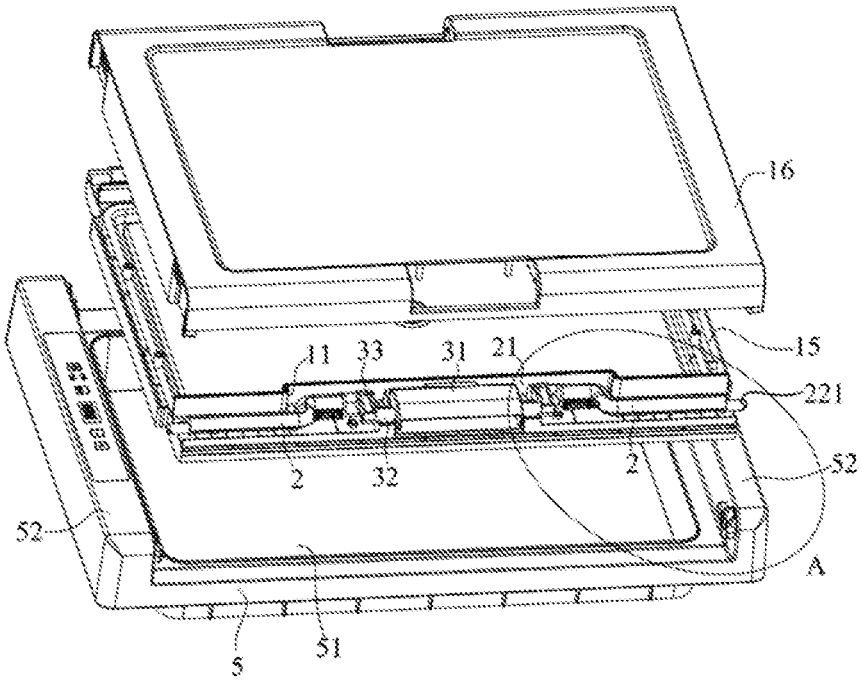
FIG. 3 is an exploded diagram of a refrigeration device provided in the present invention when a retractable shaft is extended.
Figure 4:
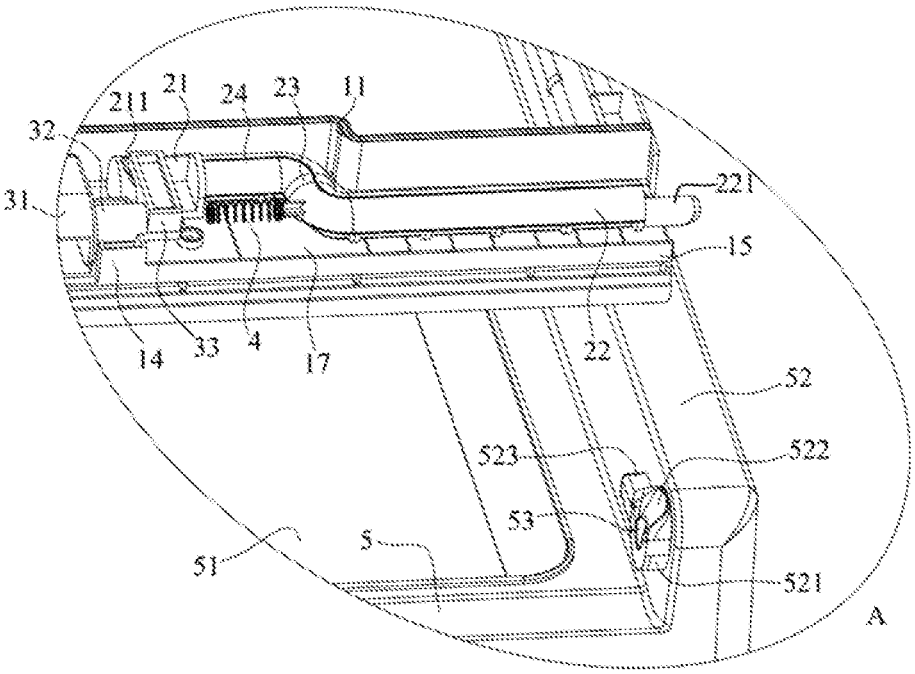
FIG. 4 is a partial enlarged view of region A in FIG. 3.

Specifically, the first return member 4 in this embodiment is a compression spring, and the outer end of the retractable shaft 2 is an insert-connection part 221. As shown in FIGS. 3 and 4, when the handle 3 (comprising a gripping part 31, a handle shaft 32 and the drive part 33 in the figures) is released, the retractable shaft 2 is pushed outwards by the compression spring, and the insert-connection part 221 extends outwards, projecting from an end face of the main body part 5 at the insert-connection part 221.

Figure 5:
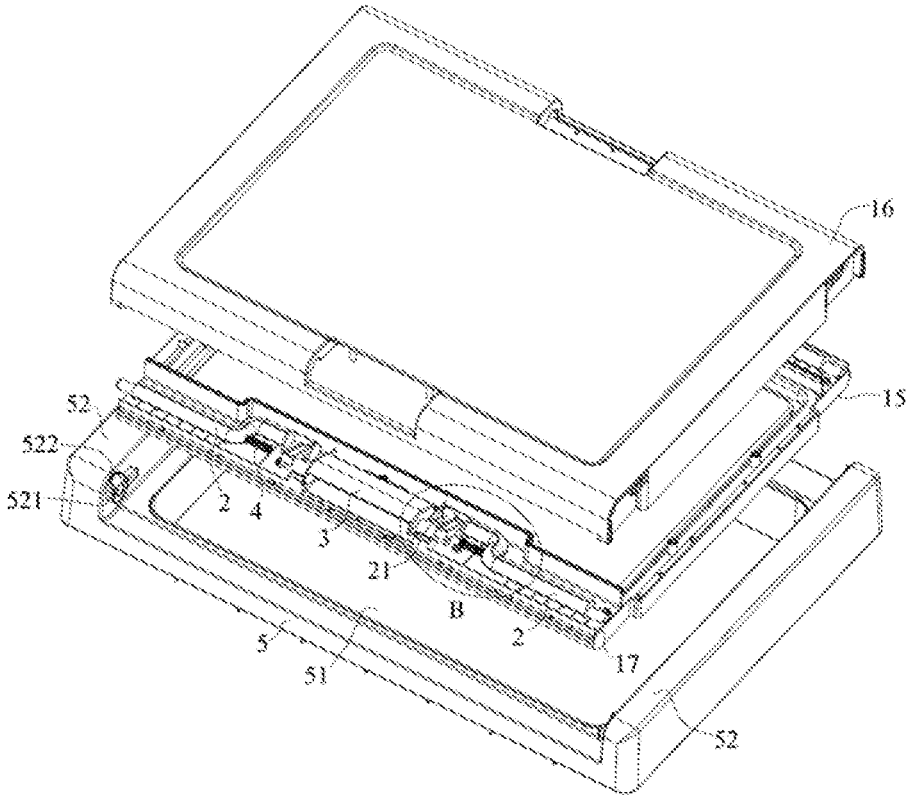
FIG. 5 is an exploded diagram of a refrigeration device provided in the present invention when a retractable shaft is retracted.
Figure 6:
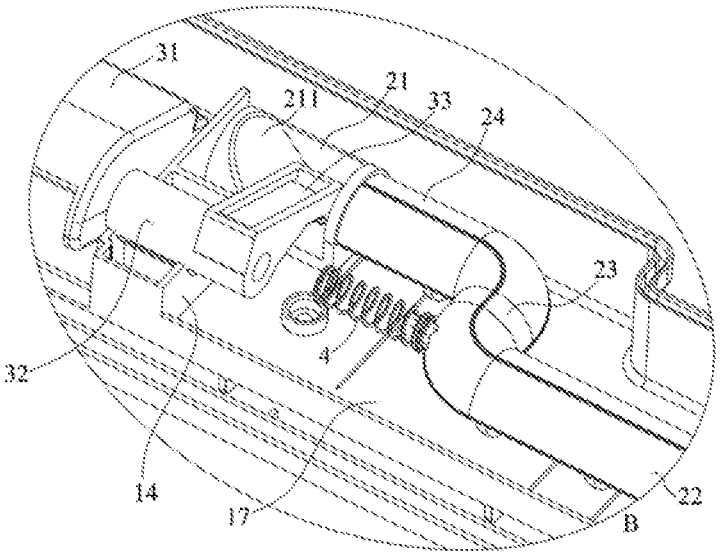
FIG. 6 is a partial enlarged view of region B in FIG. 5.
Figure 7:
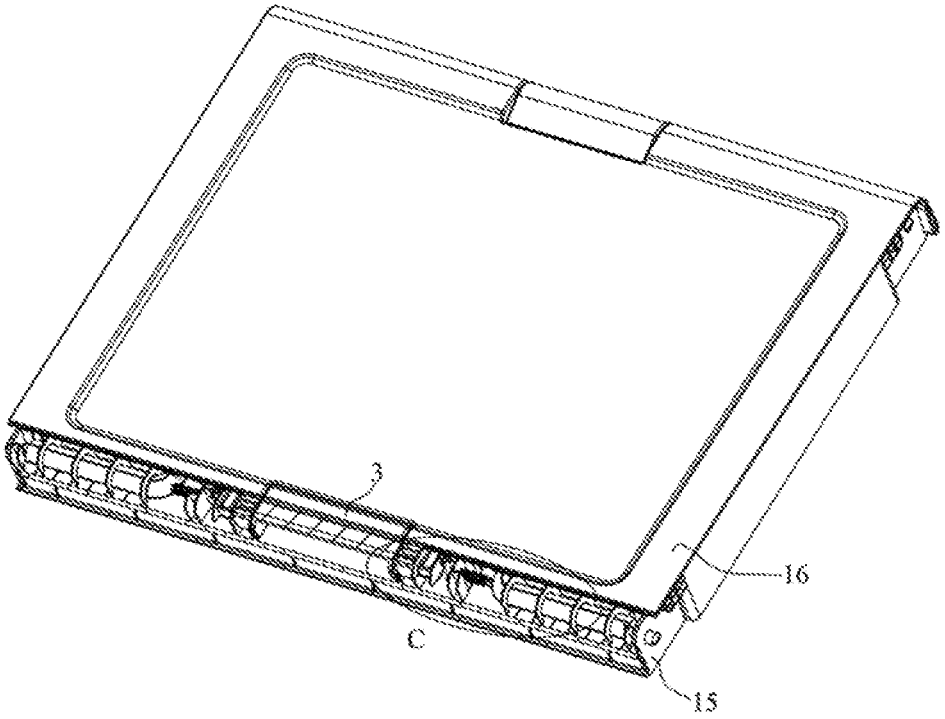
FIG. 7 is a schematic structural diagram of a door of a refrigeration device provided in the present invention, with a lateral edge cut open.

As shown in FIGS. 5 and 6, when the handle 3 rotates, it drives the driving part 33 to press down; when pressing down, the driving part 33 slides along the first guide face 211, and drives the retractable shaft 2 to slide inwards using the first guide face 211, such that the insert-connection part 221 retracts.

In the door of the present invention, the first guide face 211 is disposed on the retractable shaft 2 directly, and by making use of the cooperation between the drive part 33 of the handle 3 and the first guide face 211, the retractable shaft 2 can be driven to slide by the rotation of the handle 3 directly, with no need for another structure such as a connecting rod; the overall structure is simple, the failure rate is low, reliability is high, little space is occupied, and arrangement is convenient. When the handle 3 is released, the first return member 4 maintains an extended state of the retractable shaft 2, facilitating mating with another component, to lock the door. Compared with a push-type handle, the rotatable handle 3 occupies less space and is convenient to arrange.

Specifically, a first guide slot 21 is provided on the retractable shaft 2, with the first guide face 211 being formed on a side wall of the first guide slot 21; the first guide face 211 is arranged to be inclined from a top part of the first guide slot 21 to a bottom part, in a direction of outward extension of the retractable shaft 2, such that when the drive part 33 of the handle 3 rotates towards the interior of the first guide slot 21, the retractable shaft 2 can be driven to retract inwards. The drive part 33 generally only moves within a space of the first guide slot 21, and need not project from the first guide slot 21, so the amount of space occupied by the entire structure can be further reduced. The drive part 33 is provided with an abutment face 331 in a region abutting the first guide face 211; the abutment face 331 and the first guide face 211 are inclined in the same direction. The abutment face 331 helps to increase the area of contact between the drive part 33 and the first guide face 211, making it easier for the drive part 33 to drive the first guide face 211 to slide.

The retractable shaft 2 comprises an outer connection part 22, a bend part 23 and an inner connection part 24 which are connected in sequence; the insert-connection part 221 is located at an outer end of the outer connection part 22; the outer connection part 22 and the inner connection part 24 are parallel and not coaxial; the first guide slot 21 is disposed on the inner connection part 24. The drive part 33 of the handle 3 can cooperate with the inner connection part 24 of the retractable shaft 2, driving the inner connection part 24 to move; the inner connection part 24 and outer connection part 22 arranged in parallel can maintain a uniform sliding direction, to facilitate sliding of the retractable shaft 2 and good force-bearing. The first return member 4 in this embodiment is a spring, which is connected separately to the bend part 23 and the door main body 1, and drives the entire retractable shaft 2 to extend outwards by means of the bend part 23. The door main body 1 is provided with a first limiting part 11, for restricting a limit position of outward sliding of the bend part 23. The bend part 23 is mainly used for cooperation with the spring and cooperation with the first limiting part 11, for the purpose of keeping the retractable shaft 2 in a limit position of outward extension. The bend part 23 in this embodiment is perpendicular to the outer connection part 22 and the inner connection part 24, such that an action force of the spring can also be parallel to the sliding direction of the retractable shaft 2, to facilitate sliding of the retractable shaft 2. The spring in this embodiment is a compression spring, but this embodiment could also use a tension spring; if a tension spring is used, then a position of connection is opposite to that of the compression spring, and the bend part 23 must be pulled outwards.

Multiple second limiting parts 12 are provided on the door main body 1 in this embodiment; the multiple second limiting parts 12 are arranged in sequence in the sliding direction of the retractable shaft 2, and are provided with limiting grooves 121 in a sliding region of the outer connection part 22, with the outer connection part 22 sliding in the limiting grooves 121. The limiting grooves 121 of the multiple limiting parts 12 together form an overall limiting structure, defining the sliding direction of the retractable shaft 2. In addition, the multiple second limiting parts 12 also serve as support structures in the door main body 1, and can reinforce support strength inside the door main body 1.

Figure 8:
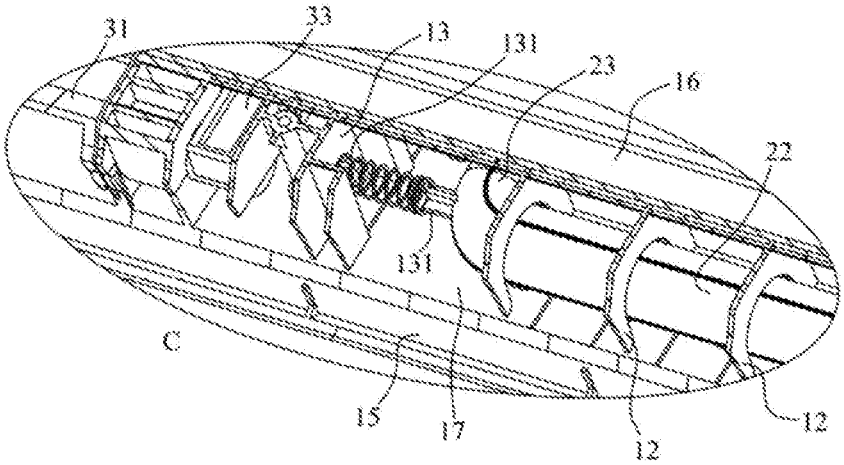
FIG. 8 is a partial enlarged view of region C in FIG. 7.
Figure 9:
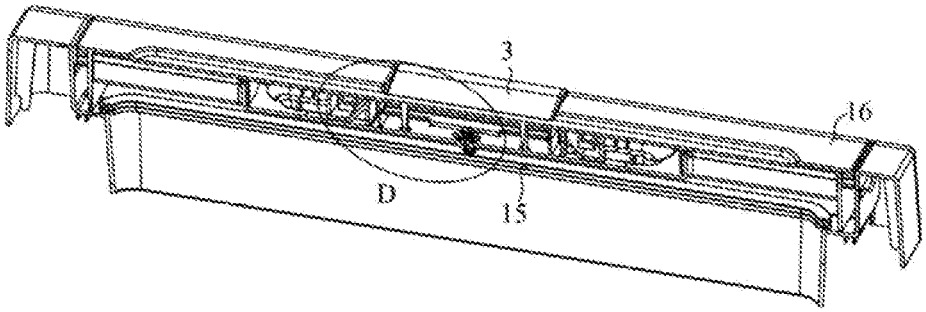
FIG. 9 is a schematic structural diagram of a refrigeration device provided in the present invention, cut open from the inside close to a lateral edge.
Figure 10:
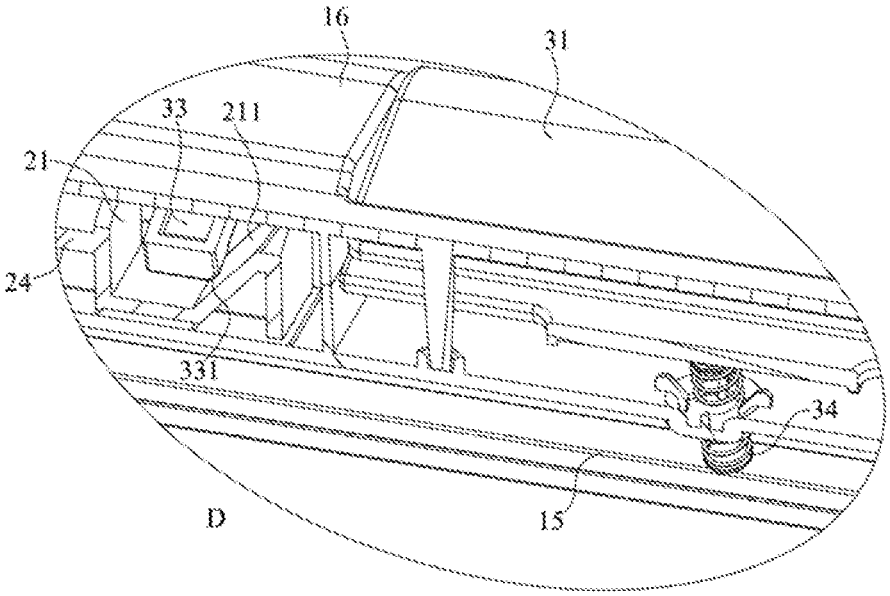
FIG. 10 is a partial enlarged view of region D in FIG. 9.
Figure 11:
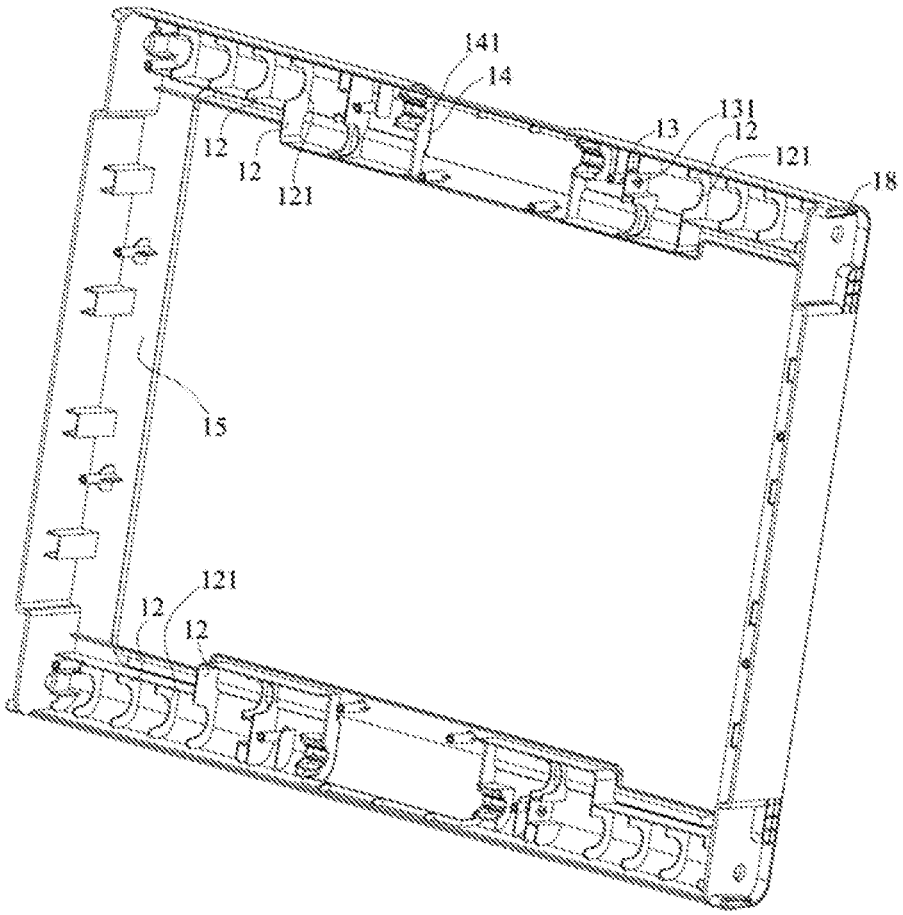
FIG. 11 is a schematic structural diagram of an inner side of an outer face plate provided in the present invention.
Figure 12:
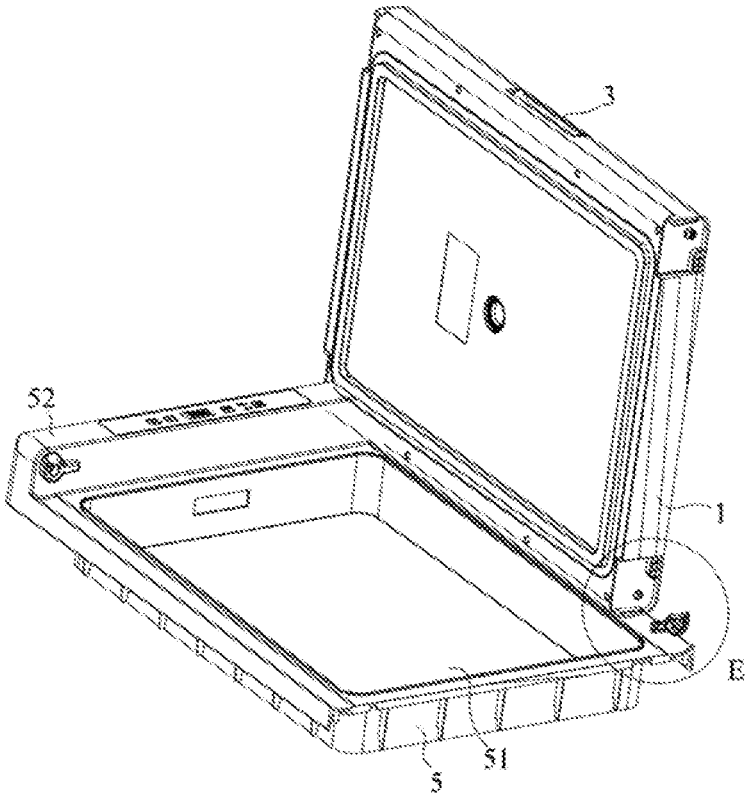
FIG. 12 is an exploded diagram of a refrigeration device provided in the present invention, with the door open and a supporting part partially cut open.
Figure 13:
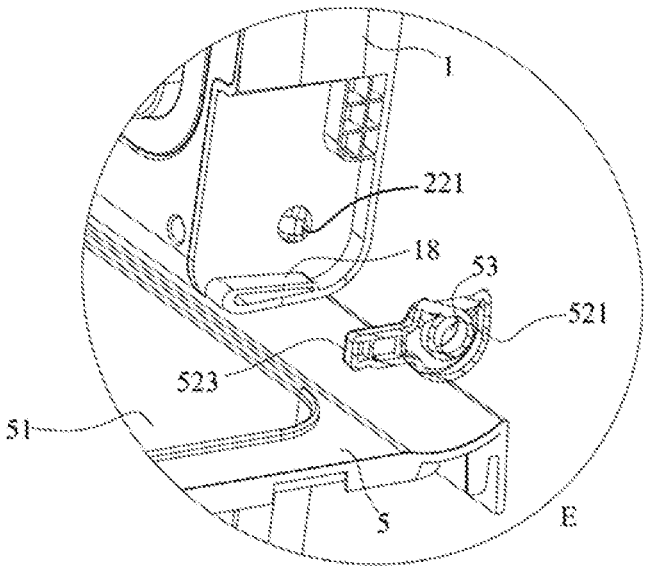
FIG. 13 is a partial enlarged view of region E in FIG. 12.

As shown in FIG. 8, a third limiting part 13 may also be provided on the door main body 1; the third limiting part 13 and the bend part 23 are arranged opposite each other, and are each provided with a limiting post 131 in a protruding manner on opposite faces. Two ends of the spring are separately engaged in the limiting posts 131, and the spring can thereby be prevented from falling off. The limiting posts 131 may be arranged to both be parallel to and even coaxial with the outer connection part 22; stable force-bearing by the outer connection part 22 can thereby be maintained.

To facilitate rotation of the handle 3, the handle 3 comprises the gripping part 31, and handle shafts 32 arranged on two sides of the gripping part 31 in a protruding manner; the drive part 33 is connected to an outer end of the handle shaft 32, and a fourth limiting part 14 is provided on the door main body 1 in a protruding manner, with the fourth limiting part 14 being provided with a rotation groove 141 for accommodating the handle shaft 32. When the gripping part 31 is rotated, the handle 3 can rotate around the handle shaft 32, so the structure is simple. One end of the gripping part 31 is used for gripping; another end is further provided with a second return member 34. In this embodiment, the second return member 34 is a spring. The spring can keep the gripping part 31 in a pressed-down state, such that the drive part 33 is normally in a lifted state, and action on the retraction shaft 2 can be avoided. When it is necessary to rotate the handle 3, the drive part 33 is caused to press down by rotating the gripping part 31.

In this embodiment, the door main body 1 comprises a closing plate 15 and an outer face plate 16 which are fastened together; the closing plate 15 is used for closing the opening 51. Once the closing plate 15 and the outer face plate 16 have been fastened together, an accommodating region 17 is formed at a side part; the accommodating region 17 accommodates the retractable shaft 2, the handle 3 and the first return member 4. The first limiting part 11, second limiting parts 12, third limiting part 13 and fourth limiting part 14 may all be disposed on the closing plate 15, or all disposed on the outer face plate 16, or disposed on both the closing plate 15 and the outer face plate 16, so the manner of arrangement is very flexible. In addition, in order to better support the closing plate 15 and the outer face plate 16, the first limiting part 11, second limiting parts 12, third limiting part 13 and fourth limiting part 14 may all be provided in the form of supporting rib plates, which can not only have a limiting action on the corresponding components, but can also increase the support strength between the closing plate 15 and the outer face plate 16, and increase the structural strength of the door main body 1.

At two sides of the opening 51, supporting parts 52 are formed in a protruding manner on the main body part 5 of the refrigeration device provided in this embodiment. Inner sides of the supporting parts 52 are opposite one another, the inner sides of the supporting parts 52 each being provided with a corresponding insertion hole 53, with each pair of corresponding insertion holes 53 being one set of insertion holes 53. The abovementioned door is located between the opposite supporting parts 52; the door main body 1 is provided with a retractable shaft 2 at a position opposite each insertion hole 53, and the two retractable shafts 2 corresponding to each set of insertion holes 53 both cooperate with one handle 3. When the outer ends of the retractable shafts 2 extend outwards and are inserted into the insertion holes 53, the door main body 1 is hinge-connected to the supporting parts 52. When the handle 3 rotates such that the retractable shafts 2 retract inwards and disengage from the insertion holes 53, the door main body 1 is separated from the supporting parts 52.

The use of the abovementioned door in the refrigeration device enables the door main body 1 to be hinge-connected to and separated from the supporting parts 52 very conveniently, thereby facilitating closing or opening of the opening 51. The door main body 1 uses the two retractable shafts 2 corresponding to each set of insertion holes 53 to hinge-connect the supporting parts 52 to the side on which this set of insertion holes is located, such that the door main body 1 can rotate around two retractable shafts 2. As the two retractable shafts 2 corresponding to each set of insertion holes 53 both cooperate with one handle 3, extension and retraction of the two retractable shafts 2 on the same side can be achieved directly by rotating one handle 3, so operation is facilitated.

Figure 2:
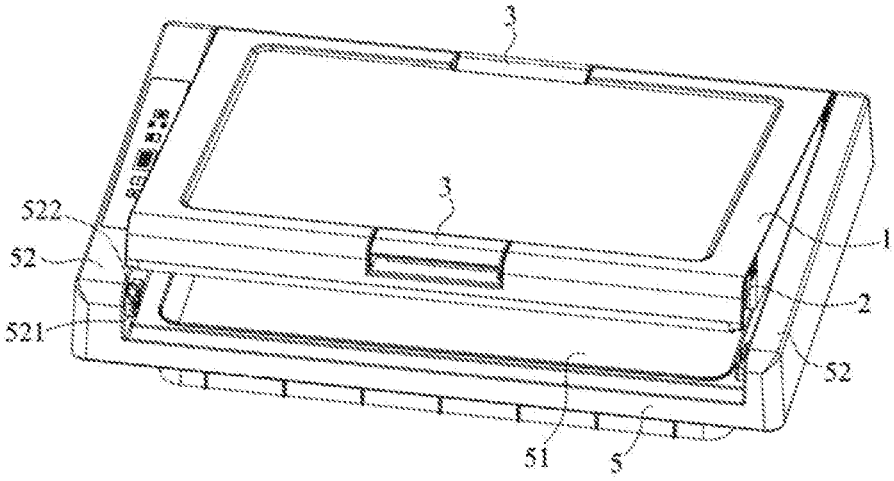
FIG. 2 is a schematic structural diagram of a refrigeration device provided in the present invention when the door is open.

In this embodiment, the supporting parts 52 are provided with two sets of insertion holes 53; the two sets of insertion holes 53 are located on two sides of the supporting parts 52 respectively, and located on an outer side of the opening 51. Through the provision of two sets of insertion holes 53, with corresponding retractable shafts 2 and handles 3 being provided on two sides of the door main body 1 respectively, hinge connection and disengagement can be achieved at each of the two sides of the door main body 1. As shown in FIGS. 1 and 2, when it is only necessary to open the door, one side of the door main body 1 can be disengaged from the supporting parts 52 by rotating either one of the handles 3, while the other side remains hinge-connected, and the door can be rotated to open the opening 51. In this way the door can be opened from two sides separately, making use convenient, and avoiding a situation where the door cannot be opened when there is an obstruction at one side in the direction of opening. If it is necessary to remove the entire door, then both handles 3 can be rotated at the same time, such that both sides of the door main body 1 are disengaged from the supporting parts 52, and the entire door main body 1 is taken out.

To facilitate insertion of the retractable shaft 2 of the door into the insertion hole 53, a hinge connection part 521 is provided in a protruding manner on the inner side of the supporting part 52; the hinge connection part 521 is provided with the insertion hole 53, and a second guide slot 522 is provided on an outer side of the insertion hole 53. A bottom face of the second guide slot 522 is inclined from a top end of the insertion hole 53 to a bottom end, in a direction of extension of the retractable shaft 2. When the door is pushed in towards the opening 51, the insert-connection part 221 at the outer end of the retractable shaft 2 slides along the first guide slot 522, and gradually enters the insertion hole 53.

A fifth limiting part 523 is also provided in a protruding manner on the inner side of the supporting part 52, and the door main body 1 is provided with a sixth limiting part 18 in a protruding manner on an end face from which the retractable shaft 2 extends; the fifth limiting part 523 and the sixth limiting part 18 cooperate to limit an angle of rotation of the door main body 1, avoiding an excessively large opening angle of the door main body 1.

An end face of the door main body 1 is provided with a recess at the position of the hinge connection part 521 and the fifth limiting part 523; during rotation of the door main body 1, the hinge connection part 521 and the fifth limiting part 523 both move within the recess. Through the provision of the recess, a lateral gap between the entire door main body 1 and the supporting part 52 can be made relatively small, and the overall structure is more aesthetically pleasing.

The above content is merely embodiments of the present invention. To a person skilled in the art, there will be room for alterations in both the particular embodiments and the range of application, based on the thinking of the present invention, so the content of this description should not be understood to be a limitation of the present invention.

The invention claimed is:

1. A door of refrigeration device, comprising:

a door main body, for closing an opening of a refrigeration space;

a retractable shaft, slidably disposed on the door main body, with an outer end of the retractable shaft being able to slide with the retractable shaft and extend outwards or retract inwards, and with a first guide face being provided on the retractable shaft;

a first handle on one side of the door main body, capable of rotating relative to the door main body, the first handle being provided with a drive part cooperating with the first guide face, wherein when the drive part rotates with the first handle, the drive part can slide along the first guide face and drive the retractable shaft to slide inwards;

a first return member, connected separately to the door main body and the retractable shaft, and driving the retractable shaft to slide outwards;

a second retractable shaft, slidably disposed on the door main body, with an outer end of the second retractable shaft being able to slide with the retractable shaft and extend outwards or retract inwards, and with a second guide face being provided on the second retractable shaft;

a second handle on a second side of the door main body, capable of rotating relative to the door main body, the second handle being provided with a drive part cooperating with the first guide face, wherein when the drive part rotates with the second handle, the drive part can slide along the first guide face and drive the second retractable shaft to slide inwards;

a second return member, connected separately to the door main body and the second retractable shaft, and driving the second retractable shaft to slide outwards;

wherein a first guide slot is provided on the retractable shaft, with the first guide face being formed on a side wall of the first guide slot, and the first guide face being arranged to be inclined from a top part of the first guide slot to a bottom part, in a direction of outward extension of the retractable shaft.

2. The door of claim 1, wherein a second guide slot is provided on the second retractable shaft, with the second guide face being formed on a side wall of the second guide slot, and the second guide face being arranged to be inclined from a top part of the second guide slot to a bottom part, in a direction of outward extension of the second retractable shaft.

3. The door of claim 1, wherein said door main body capable of being opened in a first direction with said first handle and a second direction with said second handle.

4. The door of claim 3, wherein said first direction and said second direction being parallel.

5. The door of claim 1, wherein said retractable shaft and said second retractable shaft being parallel.

6. The door of claim 1, said door main body being removable from said refrigeration space.

7. The door of claim 6, wherein said first handle and said second handle are actuatable to remove the door main body.

8. A refrigeration device, comprising:

a main body part, with a refrigeration space being provided inside the main body part, the refrigeration space being provided with an opening facing outwards, supporting parts being formed in a protruding manner on the main body part at two sides of the opening, inner sides of the supporting parts being opposite one another, and the inner sides of the supporting parts each being provided with a corresponding insertion hole, with each pair of corresponding insertion holes being one set of insertion holes; and a door being located between the supporting parts, a door main body having a first side and a second side, each of said first side and said second side being provided with a retractable shaft at a position opposite each of the corresponding insertion holes, and the two retractable shafts which correspond to each set of the corresponding insertion holes both cooperating with one of two handles;

wherein when outer ends of the retractable shafts extend outwards and are inserted into the corresponding insertion holes, the door main body is hinge-connected to the supporting parts;

when one of the two handles rotates such that the retractable shafts associated with the one of the two handles retract inwards and disengage from the insertion holes, the door main body is separated from the supporting parts and capable of hinged opening;

when both of the two handles rotate such that the two retractable shafts respectively associated with the two handles retract inwards and disengage from the corresponding insertion holes, the door main body is separated from the supporting parts and capable of removal from the main body part, further comprising a first guide slot that is provided on each of the two retractable shafts, with a first guide face being formed on a side wall of the first guide slot, and the first guide face being arranged to be inclined from a top part of the first guide slot to a bottom part, in a direction of outward extension of the two retractable shafts;

the two retractable shafts each comprise an outer connection part, a bend part and an inner connection part which are connected in sequence;

the outer connection part and the inner connection part are parallel and not coaxial;

the first guide slot is disposed on the inner connection part;

a first return member is a spring, which is connected separately to the bend part and the door main body;

the door main body is provided with a first limiting part, for restricting a limit position of outward sliding of the bend part.

9. The refrigeration device of claim 8, characterized in that the supporting parts are provided with two sets of insertion holes; the two sets of insertion holes are located on two sides of the supporting parts respectively, and located on an outer side of the opening.

10. The refrigeration device of claim 8 wherein said two handles are located opposite from one another along opposed sides of said door main body.

11. The refrigeration device of claim 8, further comprising two axes for door main body pivoting.

12. The refrigeration device of claim 11 wherein said door main body may be pivoted open in either of two directions or said door main body may be removed from the main body part.

* * * * *